United States Patent [19]

Sato

[11] Patent Number: 4,840,578

[45] Date of Patent: Jun. 20, 1989

[54] ELECTRICAL CONTACT

[75] Inventor: Kensaku Sato, Tokyo, Japan

[73] Assignee: Hirose Electric Co., Ltd., Tokyo, Japan

[21] Appl. No.: 111,601

[22] Filed: Oct. 23, 1987

[30] Foreign Application Priority Data

Oct. 30, 1986 [JP] Japan ..... 61-165797[U]
Dec. 25, 1986 [JP] Japan ..... 61-307691

[51] Int. Cl.[4] ..... H01R 4/24

[52] U.S. Cl. ..... 439/395; 439/402; 439/407; 439/877

[58] Field of Search ..... 439/389–414, 439/877, 879, 423, 442, 907, 877

[56] References Cited

U.S. PATENT DOCUMENTS 4,291,935 9/1981 Badoz et al. ..... 439/399
4,346,955 8/1982 Chesnais et al. ..... 439/407
4,461,527 7/1984 Izraeli ..... 439/397
4,464,003 8/1984 Goodman et al. ..... 439/404
4,472,596 9/1984 Brown et al. ..... 439/407
4,581,820 4/1986 Zahn et al. ..... 439/404
4,660,917 4/1987 DeRoss et al. ..... 439/404

*Primary Examiner*—David Pirlot
*Attorney, Agent, or Firm*—Takeuchi Patent Office

[57] ABSTRACT

An electric contact capable of terminating a few conductors of different thicknesses. The contact comprises a contacting section provided for contact with a mating contact and a connecting section provided behind the contacting section for connection to a conductor. The connecting section has at least two piercing walls lying in spaced parallel planes perpendicular to the axis of a conductor. The piercing walls having a piercing slit which is made wider than those preceding the piercing slit.

8 Claims, 4 Drawing Sheets

ELECTRICAL CONTACT

BACKGROUND OF THE INVENTION

The present invention relates generally to electrical contacts to be connected to conductors and, more particularly, to electrical contacts to be installed in an electrical connector, etc.

Electrical contacts may be divided into two groups; piercing type contacts and crimping type contacts. The piercing type contacts have a piercing portion with a piercing slit into which a conductor is pushed so that the the slit edges pierce the sheath and come to direct contact with the core wire. The crimping type contacts have a pair of gripping tabs to be crimped to the core wire from which the sheath has been removed.

The contact area with the core wire of a piercing type contact is smaller than that of a crimping type contact so that the current carrying capacity of the piercing type contact is smaller than that of the crimping type contact. However, the piercing type contacts are inexpensive because of their simple piercing operation and are widely used for electronic equipment which has a large number of circuits or signal lines carrying little current. By contrast, the crimping type contacts are commonly used for power lines because of their large current capacity.

Since the piercing and crimping type contacts have completely different structures, there have arisen the following problems:

(1) Recent electronic equipment requires high density mounting in which it is desired to mount both signal and power lines in the same connector. However, since the piercing and crimping type contacts are completely different in structure, many types of contacts and in turn connectors with different apertures receiving the different contacts must be provided. This increases the manufacturing costs of contacts and connectors and makes their management more difficult.

(2) Since both signal and power lines cannot be mounted in the same contact, it is difficult to achive high density mounting.

(3) When a signal line already mounted is to be exchanged with a power line or vice versa, the whole connector must be changed to another type, not only requiring additional work and additional cost but also making the circuit maintenance difficult.

(4) Individual contacts must be selected by observation according to customer's contact combination requirements, and the selected contacts must be connected to the corresponding conductors by hand. The connected contacts are assembled in a connector housing by hand, thus requiring large amounts of work and cost.

Piercing type electrical contacts are well known. For example, Japanese Patent Kokai No. 60-130,571 discloses a piercing type contact which has on the front side a female contacting section for receiving a male contact and on the rear side a pair of piercing walls with a piercing slit which penetrates the sheath and comes into direct contact with the core wire. The piercing walls are disposed in spaced parallel planes perpendicular to the axis of the conductor and each have a slit of the same width. When a conductor is pushed into these slits, the slit edges penetrate the sheath, not only coming into direct contact with the core wire but also holding the conductor in place.

In the above contacts, the thickness of a connectable conductor by piercing is determined by the slit width. Consequently, a conductor of a different thickness is to be connected, a different contact is required. Thus, various types of contacts must be made, resulting in the increased manufacturing cost. In addition, the difference in slit width between various contacts is so small that it is difficult to select right ones with naked eye, which can cause wrong contact selection, resulting in a poor connection between the contact and the conductor.

SUMMARY OF THE INVENTION

According to one aspect of the invention there is provided an electrical contact having in the front side a contacting section for contact with a mating contact and in the rear side a connectiong section for connection to a conductor, characterized in that the connecting section comprises a piercing portion with piercing wall for piercing a sheath of the conductor, coming into direct contact with a core wire of the conductor, and a crimping portion provided behind the piercing portion and having a pair of gripping tabs to be crimped to an exposed wire of another conductor.

With this structure, when a conductor is to be connected by piercing to the contact, the connection can be made by merely pushing the front end of the conductor into the piercing wall. If a conductor is to be connected by crimping to the contact, the exposed wire is placed on the crimping portion and the gripping tabs are crimped. The gripping tabs also serve as strain relief when the conductor is connected to the contact by piercing. In this way, a single type of contact can be terminated by either piercing or crimping.

According to another aspect of the invention there is provided a piercing type contact having on the front side a contacting section for contact with a mating contact and on the rear side a piercing section for connection to a conductor, characterized in that the piercing section has a plurality of piercing walls with a piercing slit, which are disposed in spaced parallel planes perpendicular to the axis of a conductor and that any of the piercing walls has a wider slit than those preceding the any piercing slit.

With the above structure, it is possible to connect by piercing a thin conductor to the front piercing wall and a thick conductor to the rear piercing wall of a single contact, thus accomodating various conductors of different thicknesses with a single type of contact.

Other objects, features, and advantages of the invention will be more fully understood from the following description when taken in conjunction with the accompanying drawings.

DESCRIPTION OF THE PREFERRED EMBODIMENTS

Figure 1:
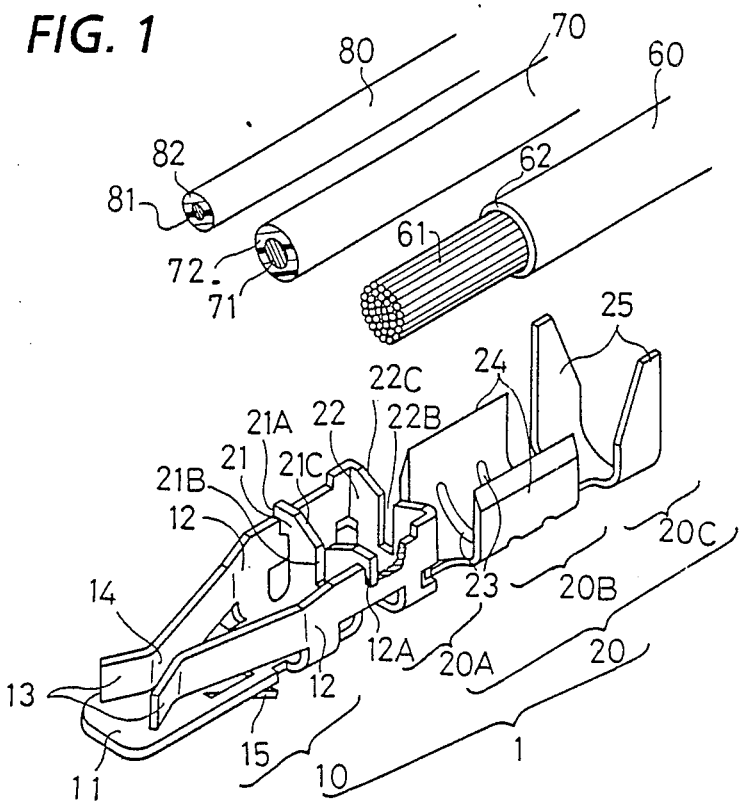
FIG. 1 is a perspective view of a contact embodying the present invention and various conductors to be connected.

In FIG. 1, a contact 1 has on the front side a female contacting section 10 for receiving a male contact for electrical connection and on the rear side a connecting section 20 for connection with a conductor.

The contacting section 10 has a pair of contact arms 13 extending forwardly and inwardly from a pair of side walls 12 which stand upright on opposite sides of a base plate 11. The front portions of the contact arms 13 are bent to form a throat portion 14. The base plate 11 has a latch tongue 15 extending downwardly so that when the contact is inserted into a contact receiving aperture 51 of an insulating housing 50 (FIG. 6), the latch tongue engages a step of the contact receiving aperture to prevent the contact from falling off from the aperture. The latch tongue 15 is made resilient so that it may be released from the aperture 51 with the aid of a simple tool.

The connecting section 20 has a piercing portion 20A, a crimping portion 20B, and a strain relief portion 20C in this order from the front side.

The piercing portion 20A has a first piercing wall 21, which has been cut out and bent upright from the base plate 11, and a second piercing wall 22, which has been made by bending the side walls 12 inwardly at the back of the first piercing wall. The first and second piercing wall are arranged in parallel to each other and substantailly perpendicular to the axis of a conductor to be connected. The first piercing wall 21 has a pair of projected upper sides 21A, which are fitted into recesses 12A of the side walls 12 to hold the piercing wall in place. The piercing wall 21 has in the middle a piercing slit 21B with a V-shaped mouth 21C. Similarly, the second piercing wall 22 has a piercing slit 22B with a V-shaped mouth 22C. The width of the piercing slit 22B is made larger than that of the piercing slit 21B.

The crimping section 20A has a U-shaped cross-section with a pair of crimping tabs 24 and on the bottom a pair of ribs 23 for reinforcing the section and crimping a conductor with more pressure than other areas.

The strain relief section 20C has a pair of gripping tabs 25 to be crimped to a conductor for retention and strain relief.

Examples of the conductors connected to the contact 1 are a power cable 60 consisting of a great number of core wires 61 and a sheath 62 covering the core wires, a signal line 70 for relatively large capacity consisting of a single relatively thick wire 71 and a sheath 72, and a signal line 80 for relatively small capacity consisting of a single relatively thin wire 81 and a sheath 82.

Figure 2:
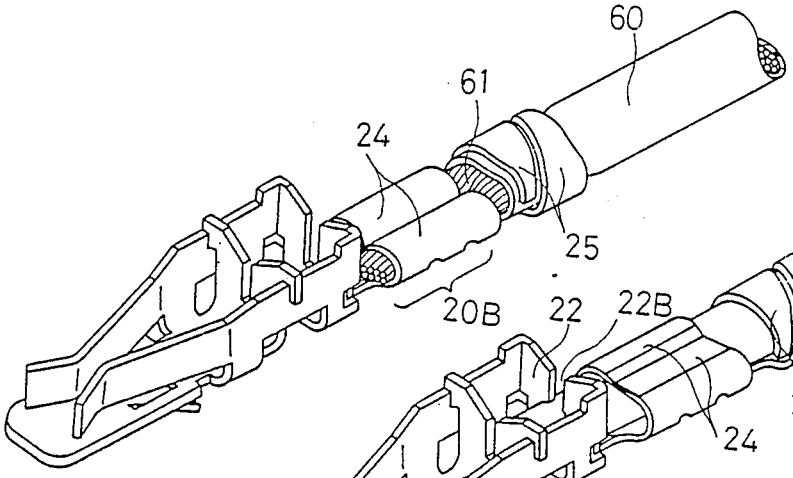
FIGS. 2–4 are perspective views of the contacts to which each of the above conductors is connected.

FIG. 2 shows the contact 1 connected to a power cable 60 by crimping the crimping tabs 24 on the exposed wires 61 and the gripping tabs 25 on the sheath 62 by means of a crimping tool (not shown).

Figure 3:
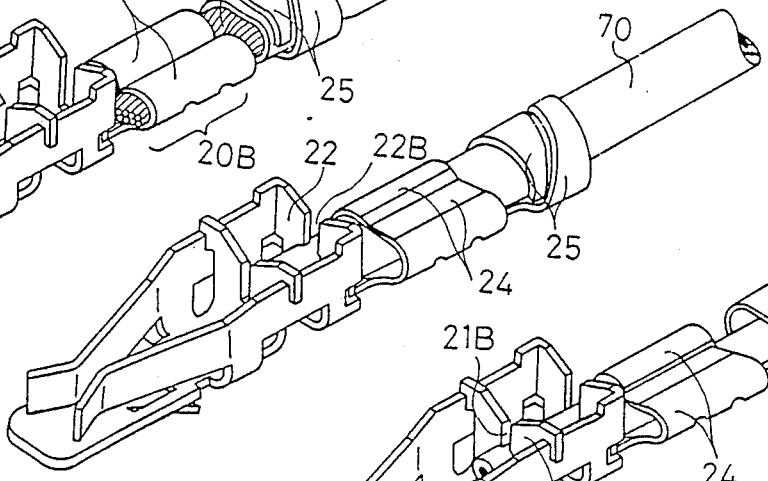

FIG. 3 shows the contact 1 connected to a relatively thick signal line 70 which is pierced by the second piercing wall 22 with a relatively thick slit 22B. The front end of the conductor 70 is pushed into the piercing slit 22B without removing the sheath in such a manner that the core wire 71 may come into direct contact with the slit edges.

Figure 4:
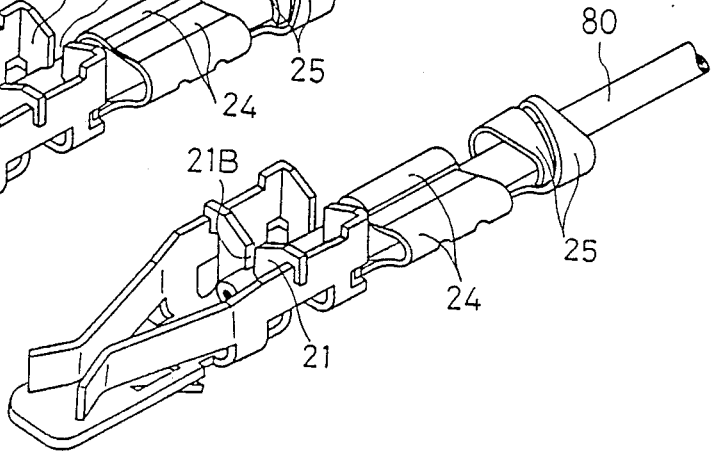

FIG. 4 shows the contact 1 connected to a relatively thin conductor 80 pierced by the first piercing wall 21 which is disposed in front of the second piercing wall 22. The width of the piercing slit 21B is made smaller than that of the piercing slit 22B.

In FIGS. 3 and 4, the sheath of the conductor is held firmly by the crimping tabs 24 and gripping tabs 25 after crimping.

Figure 5:
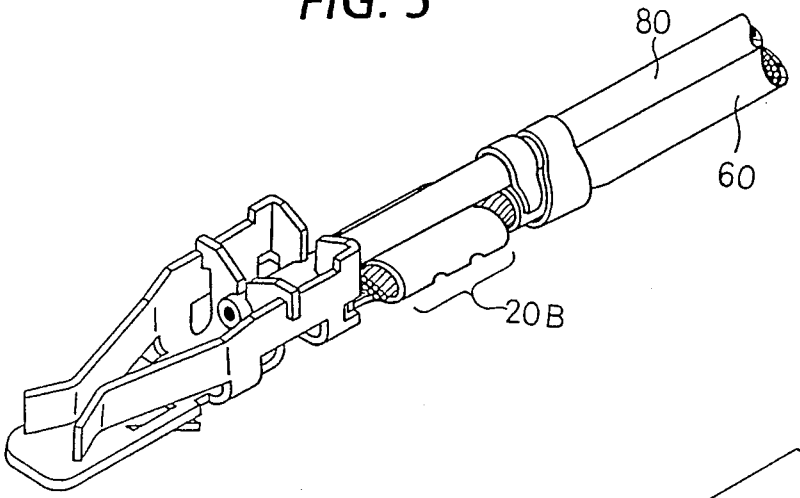
FIG. 5 is a perspective view of the contact to which two conductors are connected by piercing and crimping, respectively.

As FIG. 5 shows, it is possible to connect both power line 60 and signal line 80 to a single contact 1. After the core wires 61 are crimped in the crimping section 20B, the signal line 80 is pushed into the first piercing wall 21. Then, both power and signal lines are crimped in the strain relief section 20C. This arrangement allows high density mounting.

Figure 6:
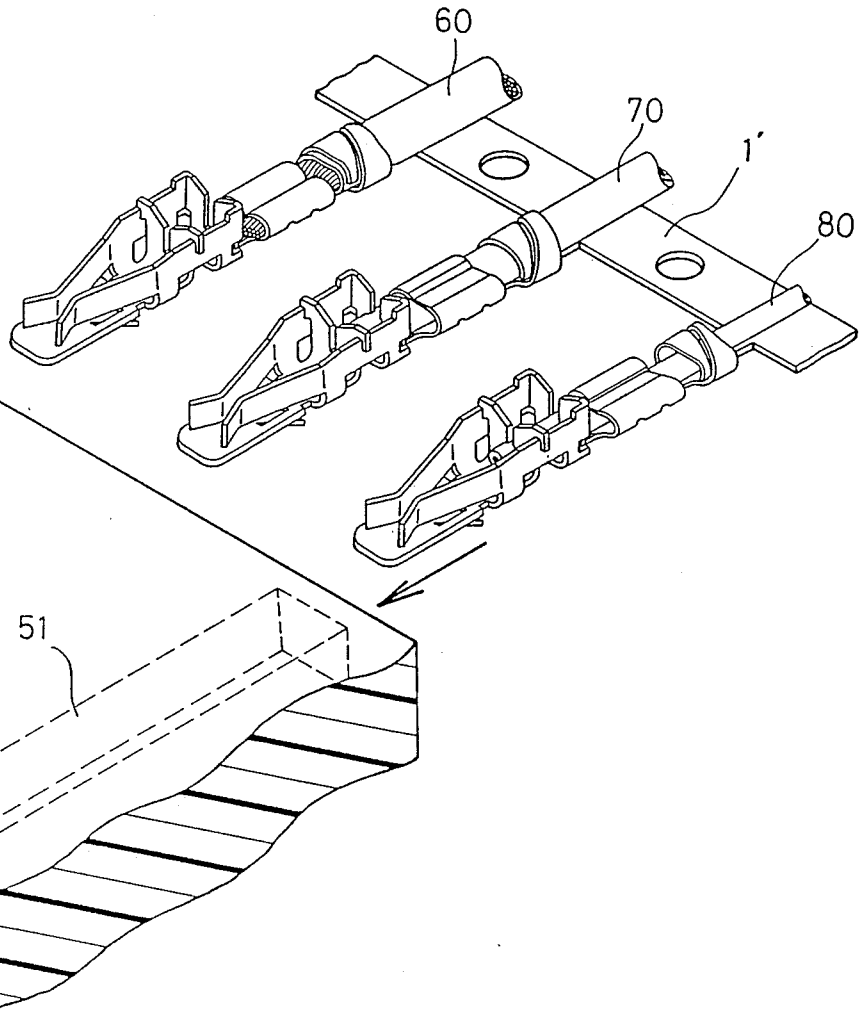
FIG. 6 is a perspective view of contacts which are linked to a strip and about to be inserted into a connector housing.

FIG. 6 shows how the contacts connected to conductors are incorporated into a connector housing 50. According to a predetermined program, various types of conductors 60, 70, and 80 are connected to contacts 1 linked to a strip 1'. The individual contacts 1 are then severed from the strip 1' and moved toward the connector housing 50 (or the connector housing is moved toward the contacts) in such a manner that the individual contacts may be inserted into the corresponding apertures 51. The connector housing 50 is moved along the strip 1' to the position at which the connectors are inserted into the housing. By doing this, various types of conductors can be arranged and connected to contacts according to a predetermined program, and the contacts are easily incorporated into the housing on the assembly line.

Figure 7:
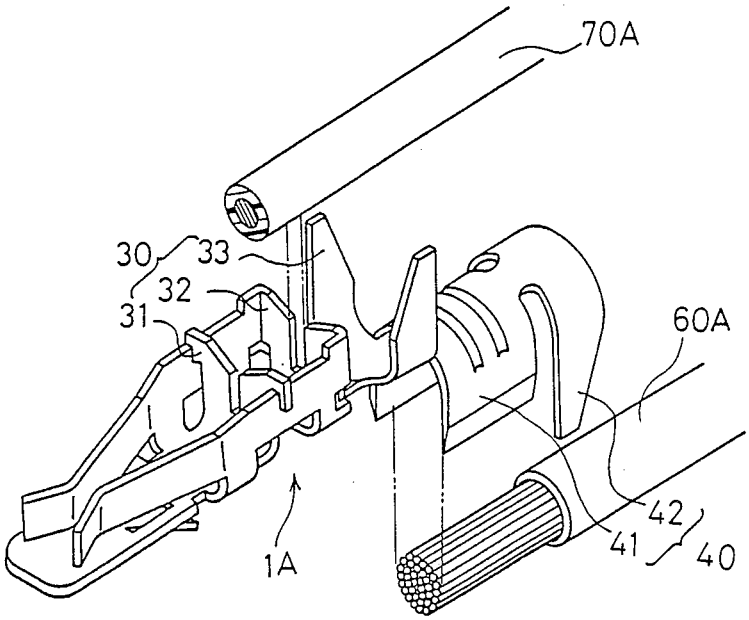
FIG. 7 is a perspective view of another embodiment of a contact according to the invention.

FIG. 7 shows another embodiment of a contact according to the invention. In the above embodiment, the piercing walls and crimping tabs extend in the same direction, but, in this embodiment, they extend in different directions. A pair of piercing walls 31 and 32 and a pair of strain relief tabs 33 extends upwardly while a pair of crimping tabs 41 and a pair of strain relief tabs 42 extend downwardly. Conductors 70A and 60A may be connected to the contact by simultaneously piercing and crimping with the aid of two upper and lower tools, thus increasing the productivity. In addition, the individual sheaths are held by the separate gripping tabs so that the retention power is increased.

According to the invention there are provided the following advantages:

(1) Since both relatively thin signal line and relatively thick power line can be connected to the same contact by piercing and crimping, respectively, so that it is possible to meet a variety of users' requirements for combinations of signal and power lines with a single type of contacts. As a result, there are no needs to provide a variety of contacts and maintain a large amount of stock.

(2) The termination to a single contact of both signal and power lines by piercing and crimping, respectively, allows high density mounting.

(3) A given signal or power line can be exchanged with another power or signal line by merely replacing the contact in the connector mounted on the circuit board. There is no needs to remove the connector from the circuit board. Thus, it is simple and economical to change or maintain the electrical circuit.

(4) A variety of conductors can easily be connected to contacts by using a predetermined program. This allows mechanization of the connections in volume, thus reducing the manufacturing cost and the delivery time.

Figure 8:
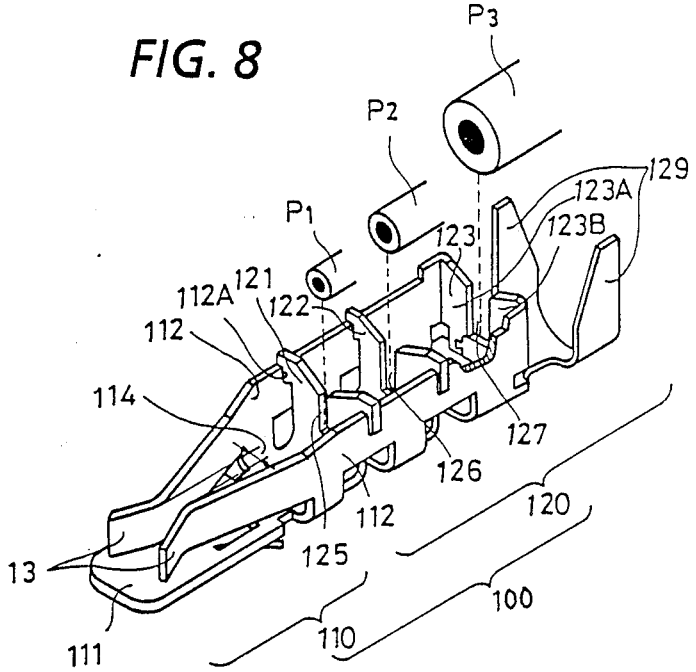
FIG. 8 is a perspective view of a piercing contact embodying the present invention.

In FIG. 8 there is shown a piercing type contact 100 which has on the front side a female contacting section 110 for receiving a mating male contact (not shown) and on the rear side a piercing section 120 in which a conductor is connected by piercing.

The contacting section 110 has a pair of contacting arms 113 extending forwardly and inwardly from a pair of side walls 112. The front portions of the contacting arms 113 are bent to form a throat portion 114. The contacting arms 113 are sufficiently resilient to receive a mating male contact through the throat portion 114 for making resilient contact therewith.

The piercing section 120 has three piercing walls 121, 122, and 123, all of which have been cut out and bent upright from the base plate 111 so that they lie in spaced parallel planes perpendicular to the axis of a conductor. The piercing wall 121 has a pair of projected upper sides 121A which are fitted into recesses 112A of the side walls 112 to hold the piercing wall in place. The piercing wall 122 is held in place in the same manner as the piercing wall 121. The piercing wall 123 is made by bending the rear ends of side walls 112 inwardly by about 90 degrees. Preferably, one side of the piercing wall 123A is provided with a latch recess and the other side of piercing wall 123B is provided with a spear-shaped latch tab for engagement with the latch recess to prevent separation of the piercing walls 123A and 123B.

The piercing walls 121, 122, or 123 has in the middle a piercing slit 125, 126, or 127 which extends upwardly and opens outwardly on the top. The width of the piercing slit 125 is the smallest while the width of the piercing slit 127 is the largest among them.

Behind the piercing section 120 there are provided a pair of strain relief tabs 129 for holding the conductor connected to the contact by piercing.

A method of connecting by piercing a conductor to the contact of the invention will be described.

As FIG. 8 shows, there are various conductors; a conductor P1 having a thin core wire, a conductor P2 having a thicker core wire than P1, and a conductor P3 having the thickest core wire among these conductors. When the conductor P1 is connected, the front portion of the conductor P1 is positioned on top of the piercing wall 121 with the thinnest slit 125.

Figure 9:
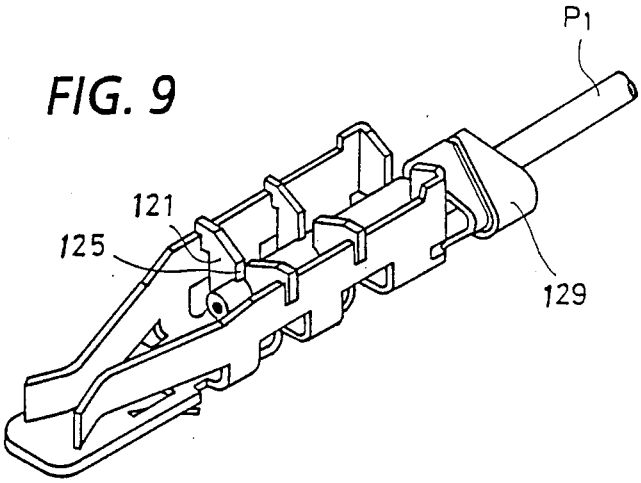
FIG. 9 is a perspective view of the piercing contact of FIG. 8, to which a conductor has been connected.

Then, the conductor P1 is pushed into the slit 125 so that the slit edges penetrate the sheath of the conductor P1 and come into direct contact with the core wire as shown in FIG. 9. At the same time, the conductor P1 is pushed into the slits 126 and 127 of the piercing walls 122 and 123 disposed behind the piercing wall 121, but these thicker slits penetrate only part of the sheath and hold the conductor in place. Simultaneously, the strain relief tabs 129 are crimped to hold the conductor firmly.

Figure 10:
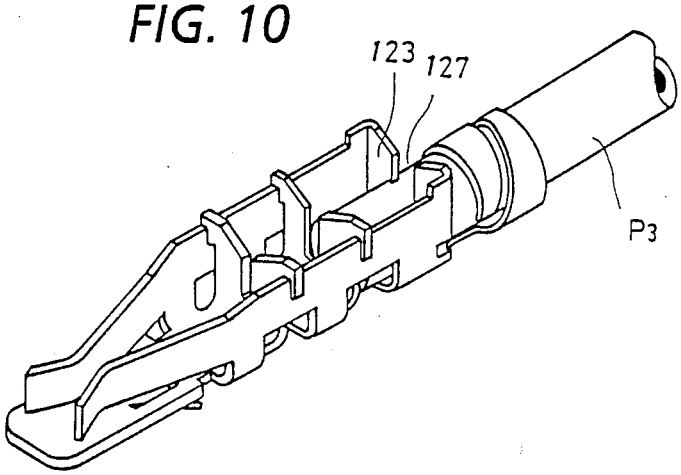
FIG. 10 is a perspective view of the contact of FIG. 8, to which a thick conductor has been connected.

When the conductor P2 or P3 having a thicker core wire than P1 is connected, it is pushed into the slit of the middle wall 126 or the rear wall 127 for connection. FIG. 10 shows the thickest conductor P3 pushed into the slit 127 of the piercing wall 123 for connection.

In this way, according to the invention, a conductor of a given thickness may be connected by piercing to a single type of contact.

Figure 11:
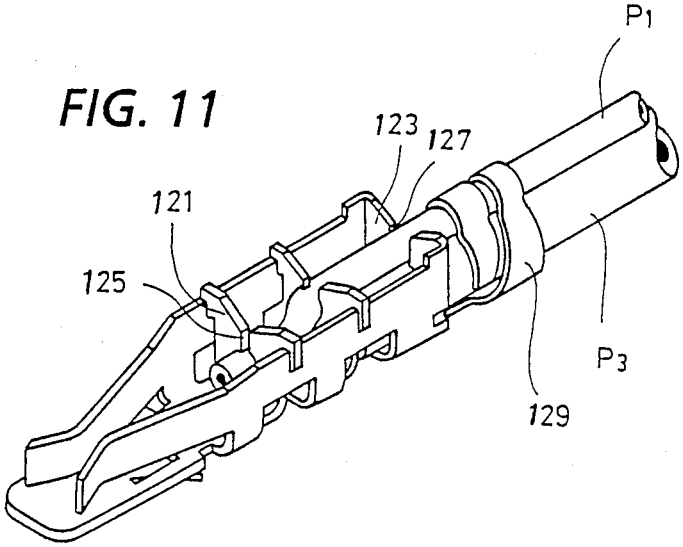
FIG. 11 is a perspective view of the contact of FIG. 8, to which a pair of conductors have been connected.

FIG. 11 shows another example of termination. In contrast to the above applications, in which only a single conductor is connected, in this example, a pair of conductors are connected by piercing. That is to say, after the thickest conductor P3 is pushed into the slit 127, the thinnest conductor P1 is pushed into the slit 125 over the conductor P3. Then, the strain relief tabs 129 are crimped to hold the conductors P1 and P3 in place.

In this way, according to the invention, a pluraliry of conductors with different current capacities may be connected by piercing to a single contact, thus making the production of high density mounting connectors possible.

According to the invention there are provided a plurality of piercing walls with a slit which is always wider than that of the preceding piercing wall so that the proper piercing slit may be always available for a conductor of a given thickness. In addition, since a plurality of conductors can be connected by piercing to a single contact, an amount of stock of various contacts may be reduced to a great extent. Moreover, the selection of contacts with wrong slits may be eliminated, thus minimizing the occurrences of poor connection resulting from the wrong contact selection.

While a preferred embodiment of the invention has been described using specific terms, it is to be understood that changes and variations may be made without departing from the spirit and scope of the invention as recited in the appended claims.

I claim:

1. An electrical contact having a generally U-shaped cross section, with a pair of side walls extending upright from a base plate, which comprises:

a contacting section provided at a front end of said contact for contact with a mating contact;

a connecting section provided behind said contacting section for connection to at least one conductor;

said connecting section having at least three piercing walls lying in spaced parallel planes each perpendicular to a longitudinal axis of said conductor;

said piercing walls each having a piercing slit which is made wider progressively toward a rear end of said contact; and a pair of engaging means provided at opposite upper side edges of each said piercing wall for engagement with said side walls, whereby each said piercing wall is held firmly in place.

2. The electrical contact of claim 1, wherein a last of said piercing walls is integral with said side walls substantially at right angles;

one side of said last piercing wall has a latch recess on a free end; and the other side of said last piercing wall has on a free end a spear-shaped latch tab for engagement with said latch recess to prevent separation of said last piercing wall.

3. The electrical contact of claim 1, wherein said engaging means is a projection extending laterally from an upper side edge.

4. The electrical contact of claim 1, wherein said side wall has a notch for engagement with said projection of said piercing wall.

5. An electrical contact having a generally U-shaped cross section, with a pair of side walls extending upright from a base, which comprises:

a contacting section for contact with a mating contact;

a connecting section provided behind said contacting section for connection to at least one conductor, said connecting section including:

a piercing portion having at least one piercing wall for piercing a sheath of a relatively thin conductor suitable for carrying an electrical signal, coming to direct contact with a core wire of said relatively thin conductor;

a crimping portion provided behind said piercing portion and having a pair of crimping tabs to be deformed to a plurality of exposed core wires of a relatively thick cable suitable for carrying electric power;

a strain relief portion provided behind said crimping portion and having a pair of strain relief stabs to be deformed to said relatively thin conductor and said relatively thick cable; and said piercing portion, said crimping portion, and said strain relief portion being on a longitudinal axis of said connecting section so that said connected conductors are positioned at varying heights with respect to said base plate.

6. The electrical contact of claim 5, wherein said piercing walls are disposed in parallel planes perpendicular to an axis of said conductor and each have a slit which is wider than the slit of a preceeding piercing wall.

7. The electrical contact of claim 5, wherein said piercing wall and said crimping tabs extend in the same direction.

8. An electrical contact which comprises:

a contacting section for contact with a mating contact;

a connecting section provided behind said contacting section for connection to at least one conductor, said connecting section including:

a piercing portion having a generally U-shaped cross section, with a pair of side walls extending upright from a base, and at least one piercing wall for piercing a sheath of a relatively thin conductor suitable for carrying an electrical signal, coming to direct contact with a core wire of said relatively thin conductor;

a first strain relief portion provided behind said piercing portion and having a pair of strain relief tabs extending upright to be deformed to said relatively thin conductor;

a crimping portion provided behind said first pair of strain relief tabs and having a pair of crimping tabs extending downwardly from said base to be deformed to a plurality of exposed core wires of a relatively thick cable suitable for carrying electric power; and a second strain relief portion provided behind said crimping portion and having a pair of strain relief tabs extending downwardly to be deformed to said relatively thick cable.

* * * * *